United States Patent [19]

Nagel

[11] 4,316,184

[45] Feb. 16, 1982

[54] COMBINATION COMBUSTION-PRODUCTS DETECTOR

[75] Inventor: Richard A. Nagel, Chicago, Ill.

[73] Assignee: Pittway Corporation, Aurora, Ill.

[21] Appl. No.: 61,366

[22] Filed: Jul. 27, 1979

[51] Int. Cl.[3] ..... G08B 17/10

[52] U.S. Cl. ..... 340/628; 340/629; 340/630

[58] Field of Search ..... 340/517, 521, 628, 629, 340/630, 633

[56] References Cited

U.S. PATENT DOCUMENTS

| | | | |
|---|---|---|---|
| 3,801,972 | 4/1974 | Hokim et al. | 340/633 X |
| 3,846,772 | 11/1974 | Peberdy | 340/630 X |
| 3,868,663 | 2/1975 | Ray | 340/629 X |
| 4,091,364 | 5/1978 | Webb, Jr. | 340/629 |

FOREIGN PATENT DOCUMENTS

| | | | |
|---|---|---|---|
| 2452839 | 5/1975 | Fed. Rep. of Germany | 340/521 |
| 2615412 | 10/1976 | Fed. Rep. of Germany | 340/629 |

*Primary Examiner*—John W. Caldwell, Sr.
*Assistant Examiner*—Daniel Myer
*Attorney, Agent, or Firm*—Dithmar, Stotland, Stratman & Levy

[57] ABSTRACT

A photosensor circuit produces a first sensor signal having an amplitude related to the quantity of smoke sensed thereby. An ionization sensor circuit produces a second sensor signal having an amplitude also related to the quantity of smoke sensed thereby. A first circuit provides a first output only when both the sensor signals exceed a first level. A second circuit provides a second output when either of the sensor signals exceeds a second higher level. An alerting-signal generator is coupled to both of the circuits and is responsive to either output to provide an alerting signal.

6 Claims, 1 Drawing Figure

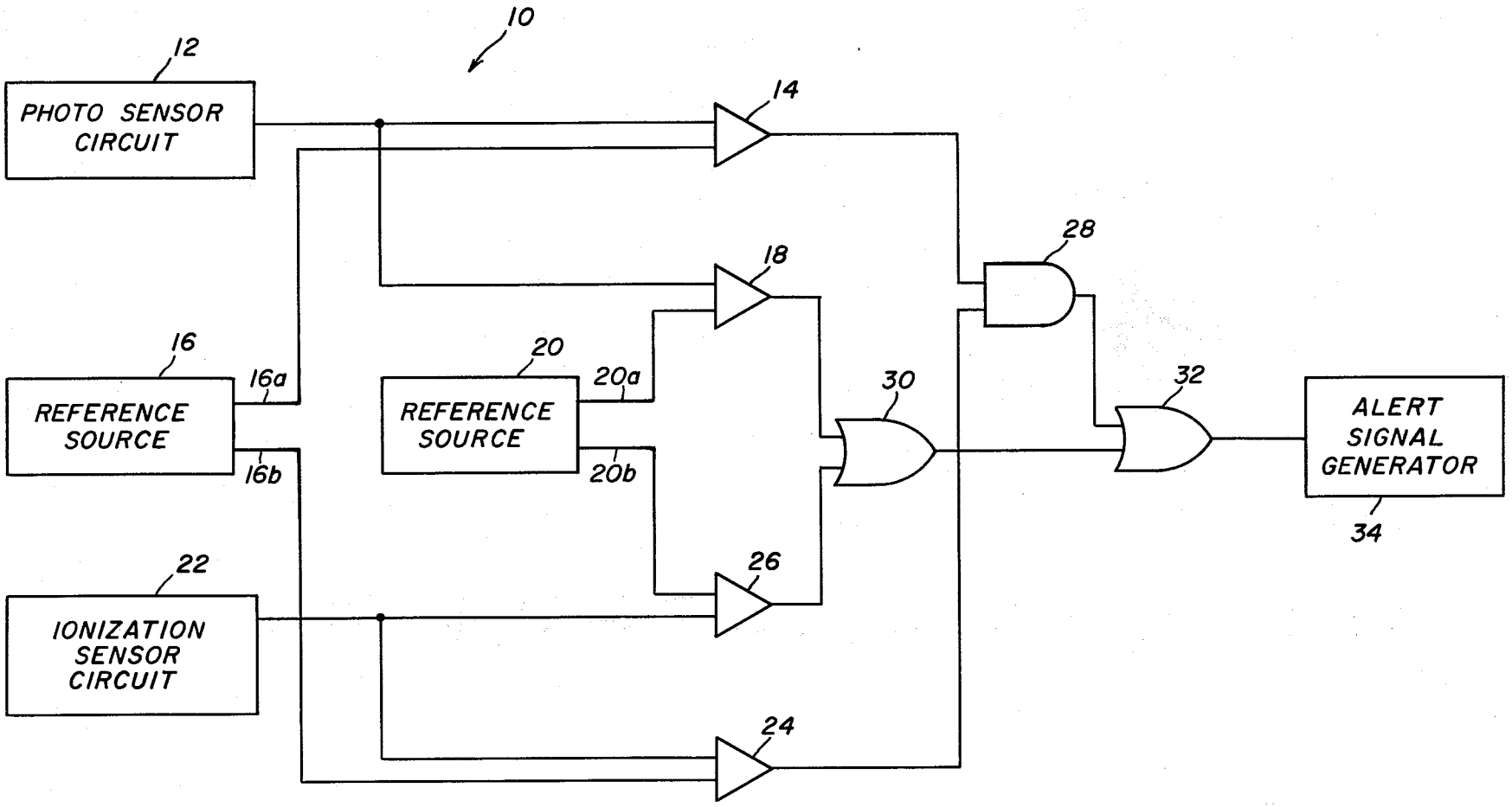
ALERT SIGNAL GENERATOR
34
32
28
30
14
18
26
24
20a
20b
20
REFERENCE SOURCE
10
16a
16b
12
PHOTO SENSOR CIRCUIT
16
REFERENCE SOURCE
22
IONIZATION SENSOR CIRCUIT

COMBINATION COMBUSTION-PRODUCTS DETECTOR

BACKGROUND OF THE INVENTION

Combustion-products detectors generally, and smoke detectors specifically, on the market today are generally of two basic types. In the photosensor type, a light from a source such as a light-emitting diode (LED) is normally directed away from a light-responsive device. In the presence of smoke, the light is caused by the smoke particles to strike the light-responsive device, thereby creating an alarm condition. Another kind of smoke sensor employs an ionization chamber defined by a pair of electrodes having a voltage thereacross. When products of combustion enter the chamber, the voltage is altered, signifying a smoke or fire condition.

There are three types of fires recognized by various approval/testing agencies. A smoldering fire is one in which a great deal of smoke is created, but very little flame. Smoldering fires can occur in upholstered furniture, for example, as the result of a burning cigarette. A smoldering fire can and often will progress into a flaming fire but it is desirable that the occupants be alerted as quickly as possible to the existence of a smoldering fire. A second type of fire produces what is commonly called "gray" smoke in which the particle size is small. In the third type "black" smoke is produced, which has a particle size between gray and smoldering smoke. A photoelectric sensor has greater sensitivity, than an ion detector, to smoke from a smoldering fire while an ion detector has greater sensitivity, than a photoelectric sensor, to black smoke.

In order to provide a combustion-products detector sensitive to all three types, there have been efforts in the past to utilize both photosensor circuitry and ionization sensor circuitry in the same combustion-products detector. In one of these prior circuits, the output of either circuit would activate the alerting-signal generator. However, these prior art detectors were subject to being falsed by air currents in the installation site. Ionization sensors are sensitive to drafts or other such movements of air and were, therefore, susceptible to falsing.

SUMMARY OF THE INVENTION

It is therefore an important object of the present invention to provide a combustion-products detector which has improved sensitivity to smoldering and flaming fires with minimum sensitivity to air currents.

In summary, there is provided a combination combustion-products detector comprising first combustion-products sensor means for producing a first sensor signal having an amplitude related to the quantity of combustion products sensed thereby, second combustion-products sensor means for producing a second sensor signal having an amplitude related to the quantity of combustion products sensed thereby, first circuit means coupled to both of the sensor means and being responsive to each of the first sensor signal and the second sensor signal exceeding a first level to provide a first output signal, second circuit means coupled to both of the sensor means and being responsive to either of the first sensor signal or the second sensor signal exceeding a second higher level to provide a second output signal, and alerting means coupled to both of the circuit means and being responsive to either of the output signals to produce an alerting signal.

The invention consists of certain novel features and a combination of parts hereinafter fully described, illustrated in the accompanying drawing, and particularly pointed out in the appended claims, it being understood that various changes in the details may be made without departing from the spirit, or sacrificing any of the advantages of the invention.

BRIEF DESCRIPTION OF THE DRAWING

For the purpose of facilitating an understanding of the invention, there is illustrated in the accompanying drawing, a preferred embodiment, from an inspection of which, when considered in connection with the following description, the invention, its construction, and operation, and many of its advantages should be readily understood and appreciated.

The single FIGURE depicts a block diagram of a combination combustion-products detector incorporating the features of the present invention.

DETAILED DESCRIPTION OF THE PREFERRED EMBODIMENT

Depicted in the drawing is a combination combustion-products detector 10 which comprises a photosensor circuit 12 well known in the art. It includes a source of light such as an LED, and also includes a light-responsive device. The light from the LED is normally directed away from the light-responsive device. However, in the presence of smoke, the light is redirected by the smoke particles so as to strike the light-responsive device and produce a sensor signal. The amplitude of such signal is substantially related to the quantity of smoke sensed by the photosensor circuit 12. In other words, the greater the quantity of smoke, the greater the amplitude of the sensor signal produced by the circuit 12. The output of the circuit 12 is coupled to a threshold detector defined by a comparator 14 having a signal input coupled to the circuit 12 and a reference input coupled to one output 16*a* of a reference source 16. The reference source 16 produces a reference voltage on the output 16*a*, thereby defining a level for the comparator 14. If the sensor signal produced by the photosensor circuit 12 is equal to or exceeds that level, then the comparator 14 will produce a threshold signal. In the absence of smoke or if the quantity of smoke is such that the sensor-signal amplitude is less than this level, then no threshold signal is produced by the comparator 14.

The combustion-products detector 10 includes a second threshold detector in the form of a comparator 18, having a signal input coupled to the output of the photosensor circuit 12 and a reference input coupled to the output 20*a* of a second reference source 20. The reference source 20 produces a second reference voltage on the output 20*a* which is higher than the reference voltage produced on the output 16*a*, whereby the reference level for the comparator 18 is greater than the reference level for the comparator 14. If the sensor signal produced by the photosensor circuit 12 has an amplitude exceeding this second higher level, then the comparator 18 produces a second threshold signal. Such signal will not be produced in the absence of smoke or if the level of the smoke is such that the amplitude of the sensor signal produced by the photosensor circuit 12 is less than this second level.

The combination combustion-products detector 10 further comprises an ionization sensor circuit 22 which has an ionization chamber across which a certain voltage appears. In the presence of smoke, that voltage is modified and as a result, the ionization sensor circuit 22 will produce a sensor signal, the amplitude of which is related to the quantity of smoke sensed thereby. A third threshold detector in the form of a comparator 24 has its signal input coupled to the ionization sensor circuit 22 and its reference input coupled to a second output **16*b* of the reference source 16. If the sensor signal produced by the ionization sensor circuit 22 exceeds the level on the output 16*b*, then the comparator 24 will produce a third threshold signal. In the absence of smoke or if the quantity of smoke is insufficient to cause the sensor signal to reach such level, no threshold signal is produced. A fourth threshold detector in the form of a comparator 26 has its signal input also coupled to the ionization sensor circuit 22 and its reference input coupled to a second output 20*b* of the reference source 20. If the sensor signal produced by the ionization sensor circuit 22 exceeds the level on the output 20*b*, then the comparator 26** produces a fourth threshold signal.

The detector 10 further includes an AND gate 28 having one input coupled to the output of the comparator 14, that is, the first threshold detector, and another input coupled to the comparator 24, that is, the third threshold detector. If each of the comparators 14 and 24 produce a threshold signal, then the AND gate 28 will produce a first output signal. If neither of the comparators 14 and 24 produce a threshold signal or if only one of them produces a threshold signal, hen no output signal will be generated by the AND gate 28.

The detector 10 further includes an OR gate 30 having its inputs respectively coupled to the comparators 18 and 26. If either of the comparators 18 or 26 produces a threshold signal, or if they both produce a threshold signal, then the OR gate 30 will produce an output signal. The outputs of the gates 28 and 30 are coupled to a second OR gate 32 which will provide a control signal in the presence of either an output signal from the gate 28 or an output signal from the gate 30. The control signal is applied to an alerting signal generator 34 to cause an alerting signal to be generated.

The photosensor circuit 12 includes a photosensor arrangement with different sensitivities to different kinds of smoke and draft conditions. The ionization sensor circuit 22 has other sensitivities to these various kinds of smoke and draft conditions. Basically, there are three types of smoke that may occur: "gray" smoke in which the particles are small and of the kind which would result from a burning wick, for example. "Black" smoke has larger particles and is the result of a flaming fire such as a burning kerosene lantern. Smoke from a smoldering fire has the largest particles. Burning wood blocks would create smoke similar to the smoke from a smoldering fire. Evaluation of the quantity of smoke in the area is typically defined by percent obscuration of a light beam. A light beam is directed through the smoke to a light detector. If 99% of the light passes to the detector through a distance of one foot, the quantity of smoke is said to be 1% obscuration per foot. If 95% passes to the detector through a distance of one foot, then the quantity of smoke is said to be 5% obscuration per foot.

The photosensor circuit 12 and the ionization sensor circuit 22 have the elements therein set to produce sensor signals of a given amplitude in response to gray smoke. For example, a 1% quantity of gray smoke will cause each circuit 12 and 22 to produce a sensor signal having an amplitude x. An increase in the percentage of gray smoke will cause a proportional increase in the amplitudes of these sensor signals.

The photosensor circuit 12 is much less sensitive to black smoke than is the ionization sensor circuit 22. For example, the photosensor circuit 12 may be four times less sensitive to black smoke as the ionization sensor circuit 22. Then, a 4% black smoke would cause the photosensor circuit 12 to produce a sensor signal having the same amplitude (x) as it did in response to 1% gray smoke, while the ionization sensor circuit would produce a sensor signal of an amplitude four times as great (4×). Such 4:1 relationship is maintained. Thus, if the quantity of black smoke doubles to 8%, the amplitude of the sensor signal produced by the circuit 12 would be 2×, while the amplitude of the sensor signal produced by the ionization sensor circuit would be 8×. It is understood that these are exemplary ratios.

On the other hand, the photosensor circuit 12 has a must greater sensitivity to smoke from a smoldering fire than does the ionization sensor circuit 22. For example, the circuit 12 may be seven times as sensitive. Then, 7% smoke from a smoldering fire would produce a photosensor signal having an amplitude seven times that produced in response to 1% gray smoke, i.e. 7×, while the ionization sensor circuit 22 would produce a sensor signal having an amplitude the same as that produced in response to the 1% gray smoke, i.e. x. If the smoldering smoke content doubled to 14%, then the sensor signal from the circuit 12 would have an amplitude of 14×, and the sensor signal from the circuit 22 would have an amplitude of 2×. Again, these are exemplary ratios.

For the purposes of example, let it be assumed that the reference voltage on the outputs **16*a* and 16*b* is 2× and the reference voltage on the outputs 20*a* and 20*b* is 4×. Then, 2% gray smoke will cause an alerting signal to be produced in the following manner. The 2% gray smoke causes the photosensor circuit 12 to produce a sensor signal having an amplitude of 2× which is applied to the comparator 14. Since the reference voltage on the reference input thereof is also 2×, a threshold signal is developed which is applied to one input of the AND gate 28. The 2% gray smoke also causes the ionization sensor circuit 22 to produce a sensor signal having an amplitude of 2×, which is applied to the signal input of the comparator 24. Since the reference voltage on the comparator 24 is also 2×, it produces a threshold signal which is applied to the second input of the AND gate 28. Since threshold signals are applied to both of its inputs, the AND gate 28 produces an output signal which is coupled to the OR gate 32 to cause an alerting signal to be produced by the generator 34** as previously explained.

If the quantity of gray smoke is less than 2%, the sensor signals produced by the circuits 12 and 22 will be less than 2× and therefore the comparators 14 and 24 will not produce threshold signals and no alerting signal will be generated.

The comparators 18 and 26 do not operate to produce threshold signals until the amplitude of the sensor signals from the circuits 12 or 22 exceed the reference voltages produced by the reference source 20, which in this example is 4×. The sensor signals have an amplitude of 4× when the gray smoke has a 4% content. As just explained, however, a 2% content in gray smoke will cause an alerting signal to be generated. Thus, the comparators 18 and 26 and the associated reference source 20 do not enter into the sensitivity of the detector 10 in response to gray smoke.

If 4% black smoke is applied to the detector 10, the photosensor circuit 12 will produce a sensor signal having an amplitude of x, while the ionization sensor circuit 22 produces a sensor signal having an amplitude 4×, in accordance with the exemplary sensitivities of these two circuits discussed above. The comparator 14 will not produce a threshold signal because the sensor signal from the circuit 12 has an amplitude (x), which is less than the reference signal (2×), quite irrespective of any threshold signal from the comparator 24. However, the comparator 26 will produce a threshold signal because the sensor signal on its input has an amplitude (4×) which is equal to the reference voltages (4×) from the reference source 20. The threshold signal will cause the OR gate 30 to produce an output signal which is coupled through the OR gate 32 to provide a control signal which causes the generator 34 to produce an alerting signal. With exemplary reference voltages of 2× and 4×, the detector 10 has a sensitivity to black smoke of 4% or greater. If the content is less than 4%, the comparator 26 will not produce a threshold signal. As previously explained, the sensor signal from the photosensor circuit 12 applied to the comparator 18 has an amplitude (x), which is less than the reference voltage (4×) from the reference source 20.

If 4% smoldering smoke is applied to the detector 10, the photosensor circuit will produce a sensor signal having an amplitude of 4×, while the ionization sensor circuit 22 will produce a sensor signal having an amplitude of less than x, assuming the photosensor circuit 12 is seven times as sensitive to smoldering smoke as the ionization sensor circuit 22. The sensor signal produced by the photosensor circuit 12 has an amplitude of 4×, which is equal to the reference voltages furnished by the reference source 20, causing the comparator 18 to produce a threshold signal. As a result, the OR gate 30 produces an output signal which in turn causes the OR gate 32 to produce a control signal to render operative the generator 34 to produce an alerting signal. If the quantity of smoldering smoke is less than 4%, the comparator 18 would not produce a threshold signal. The comparator 14 produces a threshold signal as long as the amplitude of the sensor signal from the photosensor circuit 12 is greater than 2×, but the comparator 24 will not produce a threshold signal until there is 14% smoldering smoke which would cause the ionization sensor circuit 22 to produce a sensor signal having an amplitude of 2×. Accordingly, the comparators 14 and 24 and associated AND gate 28 are not important to the sensitivity of the detector 10 to smoldering smoke.

In the foregoing example, it is assumed that the reference voltages on the outputs 16*a* and 16*b* are equal and that the reference voltages on the outputs 20*a* and 20*b* are equal. In an actual situation, however, it is unlikely that such equality will exist. The voltages produced by the photosensor circuit 12 and the ionization sensor circuit 22 in response to given smoke conditions will be substantially different in amplitude. The reference voltages will be selected in order to achieve the desired sensitivities.

The photosensor circuit 12 is nonresponsive to air currents, so that it produces no sensor signal irrespective of the amount of air movement around the detector 10. On the other hand, the ionization sensor circuit 22 produces a sensor amplitude corresponding to the wind velocity. If the wind velocity increases to a point where the sensor signal from the circuit 22 is 2×, the comparator 24 will produce a threshold signal for the AND gate 28, but the other input of such AND gate will not receive a threshold signal irrespective of the wind speed. If the speed of the air increases to the point where the ionization sensor circuit 22 produces a sensor signal having an amplitude of 4×, the comparator 26 will produce a threshold signal which, as explained previously, will result in the generator 34 producing an alerting signal. As long as the air speed is less than that which would cause the sensor signal to have an amplitude of 4×, no falsing in the presence of air currents takes place.

Thus, an important factor in determining the value of the reference voltages furnished by the reference source 20 is that it be greater than the amplitude of the sensor signal produced by the ionization sensor circuit 22 in the presence of normal wind velocity in an installation site. It is desirable that the reference voltages from the reference source 16 be as low as possible to maximize sensitivity in response to a gray smoke. However, it should not be so low as to cause an alerting signal to be produced in the presence of normal smoke conditions in the installation site, resulting from cigarettes, ovens and the like.

The sensitivities of the detector 10 to smoke using the examples of the reference voltages of 2× and 4× is 2% to gray smoke, 4% to black smoke, and 4% to smoldering smoke. At the same time the detector 10 is nonresponsive to normal air currents found occurring in a home. In other words, the detector 10 has good response to all kinds of smoke but is not falsed in the presence of air currents.

A photosensor alone would have good sensitivity to gray smoke and smoldering smoke but much poorer response to black smoke. An ionization sensor would have good sensitivity to gray smoke and black smoke but very poor sensitivity to smoldering smoke and is susceptible to falsing in the presence of normal air currents. Using both a photosensor circuit and an ionization sensor circuit coupled to an OR gate improves the sensitivity to all three types of smoke, but renders the detector susceptible to falsing in the presence of the usual air currents found in an installation site.

An important advantage of the detector 10 is that it will operate even if the photosensor circuit 12 malfunctions or the ionization sensor circuit 22 malfunctions. In other words, the detector 10 will function to produce an alarm even if either of the circuits 12 or 22 is not operative, this by virtue of the connections to the OR gate 30. The sensitivity would be less in certain situations, but an alarm will nevertheless be generated.

The detector 10 may be viewed as having a first circuit consisting of the comparators 14 and 24, the reference source 16 and the AND gate 28. Such first circuit provides an output signal only when threshold signals are produced by both of the comparators 14 and 24, which in turn occurs only when the sensor signals from the circuits 12 and 22 exceed the reference voltage established by the reference source 16.

Similarly, the detector 10 may be viewed as having a second circuit consisting of the comparators 18 and 26, the reference source 20 and the OR gate 30. Such second circuit provides an output signal when a threshold signal is produced by either (or both) of the comparators 18 and 26, which in turn occurs only when the sensor signal from the circuit 12 or the sensor signal from the circuit 22 exceeds the reference voltages established by the reference source 20.

It is to be understood that the relationships and sensitivities of the circuits 12 and 22 to each other and to the various kinds of smoke and wind conditions is only exemplary, as are the values of the reference voltages produced by the reference sources 16 and 20. Other values and relationships may be used.

What has been described, therefore, is an improved combustion-products detector which has good sensitivity to all three kinds of smoke and at the same time is not sensitive to normal air currents normally occurring in typical installation sites.

I claim:

1. A combination combustion-products detector comprising first combustion-products sensor means for producing a first sensor signal having an amplitude related to the quantity of combustion products sensed thereby, second combustion-products sensor means for producing a second sensor signal having an amplitude related to the quantity of combustion products sensed thereby, first circuit means coupled to both of said sensor means and being responsive to each of the first sensor signal and the second sensor signal exceeding a first level to provide a first output signal, second circuit means coupled to both of said sensor means and being responsive to either of the first sensor signal or the second sensor signal exceeding a second higher level to provide a second output signal, and alerting-signal generating means coupled to both of said circuit means and being responsive to either of the output signals to produce an alerting signal.

2. The combination combustion-products detector of claim 1, wherein said first combustion-products sensor means includes a photosensor, and said second combustion-products sensor means includes an ionization sensor.

3. The combination-products detector of claim 1, and further comprising an OR gate having first and second inputs respectively coupled to said first and second circuit means and an output coupled to said alerting means.

4. The combination combustion-products detector of claim 1, wherein each of said circuit means includes a pair of comparators respectively having reference inputs coupled to a reference source and having signal inputs respectively coupled to said first and second combustion-products sensor means.

5. A combination combustion-products detector comprising photosensor means for producing a first sensor signal having an amplitude related to the quantity of combustion products sensed thereby, first threshold detector means coupled to said photosensor means and being responsive to the first sensor signal exceeding a first level to provide a first threshold signal, second threshold detector means coupled to said photosensor means and being responsive to the first sensor signal exceeding a second higher level to provide a second threshold signal, ionization sensor means for producing a second sensor signal having an amplitude related to the quantity of smoke sensed thereby, third threshold detector means coupled to said ionization sensor means and being responsive to the second sensor signal exceeding the first level to provide a third threshold signal, fourth threshold detector means coupled to said ionization sensor means and being responsive to the second sensor signal exceeding the second level to provide a fourth threshold signal, AND gate means having a pair of inputs respectively coupled to said first threshold detector means and said third threshold detector means and providing a first output signal in the presence of both the first threshold signal and the third threshold signal, first OR gate means having first and second inputs respectively coupled to said second threshold detector means and said fourth threshold detector means and providing a second output signal in the presence of either the second threshold signal or the fourth threshold signal, second OR gate means having first and second inputs respectively coupled to said AND gate means and said first OR gate means and being responsive to the first output signal or the second output signal to provide a control signal, and alerting-signal generating means coupled to said second OR gate means and being responsive to the control signal to produce an alerting signal.

6. The combination smoke detector of claim 1, wherein each of said threshold detector means includes a comparator having a signal input and a reference input coupled to receive a reference voltage to establish the associated level.

* * * * *